United States Patent [19]

Kuchenbecker

[11] 4,266,666

[45] May 12, 1981

[54] BLISTER PACKAGE

[75] Inventor: Morris W. Kuchenbecker, Neenah, Wis.

[73] Assignee: American Can Company, Greenwich, Conn.

[21] Appl. No.: 105,898

[22] Filed: Dec. 21, 1979

[51] Int. Cl.[3] ..... B65D 83/00; B65D 85/14; B65D 75/58

[52] U.S. Cl. ..... 206/461; 206/467; 206/470; 206/621; 206/626; 229/45 R

[58] Field of Search ..... 206/470, 461, 484, 621, 206/626, 631, 467, 468, 469; 229/45, 43, 2.5

[56] References Cited

U.S. PATENT DOCUMENTS

| | | | |
|---|---|---|---|
| 2,783,877 | 3/1957 | Volckening et al. | 206/626 |
| 3,127,010 | 3/1964 | Capezzuto | 206/626 |
| 3,174,621 | 3/1965 | Watson | 206/470 |
| 3,327,843 | 6/1967 | O'Meara et al. | 206/470 |
| 3,559,799 | 2/1971 | Kramer et al. | 206/631 |
| 3,650,386 | 3/1972 | Tigner | 206/631 |
| 3,765,595 | 10/1973 | Bernhardt | 206/631 |
| 3,792,181 | 2/1974 | Mahaffy et al. | 206/631 |

*Primary Examiner*—William T. Dixson, Jr.
*Attorney, Agent, or Firm*—Robert P. Auber; Ira S. Dorman; Ernestine C. Bartlett

[57] ABSTRACT

A recloseable hinged blister card package is provided wherein the clear plastic blister is secured to a paperboard card which is suitably cut-scored along the secured areas to allow ply separation of the card for opening the blister. Improved tensile strength which enhances resistance to inadvertent tearing away of the blister is achieved by use of a bottom panel extension of the card that is folded 180° and secured to the blister flange at the bottom of a product holding portion of the blister. Upon opening, the blister flange at the bottom of the blister remains secured to the fold over extension. The package opens by folding the blister back, the package hinge line being the fold line of the fold over extension. Depending on the extent of the seal or adhesion of the fold over extension to the underlying card areas, the package, upon opening, will have either a partial or full thickness of paperboard in the area between the end of the fold over extension and the outer cut-score line at the base of the card. Improved tensile strength is realized with either construction.

12 Claims, 8 Drawing Figures

BLISTER PACKAGE

BACKGROUND OF THE INVENTION

PRIOR ART

The prior art is believed to be best exemplified by the following patents:

U.S. Pat. No. 3,127,010, Capezzuto, 3/1964
U.S. Pat. No. 3,942,640, Hellstrom, 3/1976
U.S. Pat. No. 4,119,203, Kuchenbecker, 10/1978

Field of the Invention

This invention relates to blister card packages and more particularly to such packages with recloseable hinged plastic blisters.

In my U.S. Pat. No. 4,119,203 dated Oct. 10, 1978 and in my copending patent applications Ser. No. 958,716 filed Nov. 8, 1978 and Ser. No. 040,100 filed May 18, 1979, there are described and claimed certain recloseable hinged blister card packages wherein a clear plastic blister is adhered to a paperboard card that is suitably cut-scored along the adhered areas to allow defined ply separation of the card for opening the blister. In said packages, the card provides a hinge at the bottom edge of the attaching flange outwardly of the adhered area. Such hinge may be either at a score line impressed at the bottom edge of the blister and above the edge of the card or it may be at a bottom folded edge of the card formed from an integral bottom panel which is folded over and adhered to the back side of the card. Where such latter construction is used, the bottom portion of the blister flange extends along the folded bottom edge of the card to provide a hinge connection to the card but where the blister remains attached to the bottom of the card.

The present invention is a modification of such blister cards as disclosed in said patent and patent applications wherein the package has improved tensile strength enhancing the resistance to inadvertent removal of the blister during opening. The improved package utilizes a bottom panel extension which is folded over and adhered to the bottom portion of the blister flange whereby upon opening, the bottom portion of the blister flange is adhered to the upper edge of the fold over extension and is swung away from the folded bottom edge of the card which provides the hinge connection.

DETAILED DESCRIPTION OF THE PREFERRED EMBODIMENTS

Figure 1:
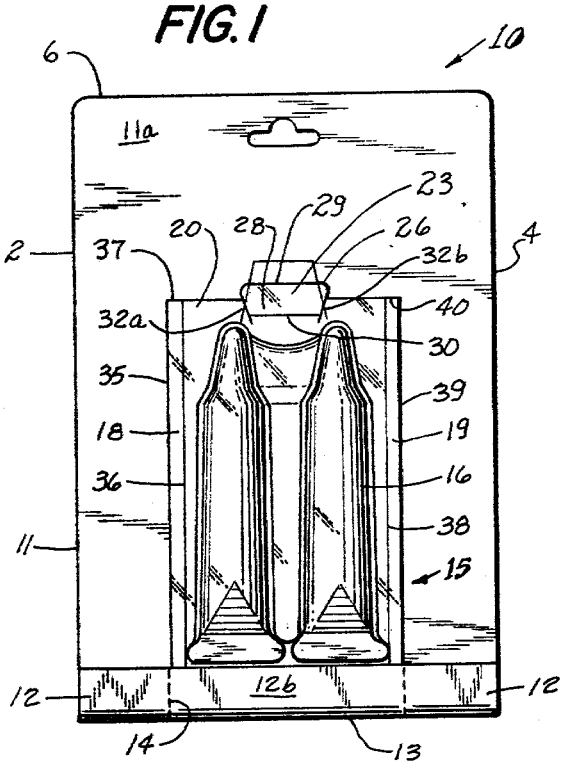
FIG. 1 is a front elevation of a recloseable hinged blister and package embodying the principles of this invention.

Referring to the drawings, a first recloseable hinged blister card package package is shown at 10 in FIGS. 1 to 4. The package comprises a paperboard card 11 having a front surface 11*a* and a back surface (not shown); side edges 2 and 4 and top edge 6. The card may have an internal edge defining an opening in said card or it may have, as illustrated, a securing segment as described below. The card has an integral bottom panel extension 12 which is folded 180° to provide a folded edge 13 at the bottom of the card. The fold over extension 12 has spaced lines of weakness 14 extending vertically from the edge 13 of the package to the top of the fold over extension 12. The lines of weakness 14 divide the extension into adhered front portion 12 and 12*b*.

A clear plastic blister 15 has a raised product holding portion 16 for holding one or more products, for example, tubes of glue, etc. The plastic blister has top, bottom and side edges and a bottom edge 22. The side portions 18 and 19 are secured to the front surface of the card as shown. In the embodiment shown in FIG. 1, top edge 20 of the blister is not secured to the card, although it may be secured, if desired.

The top portion 20 of the blister has a flexible opening and closing tab 23. In the embodiment shown, the tab has an enlarged outer portion by ears 26 which extend over an area of the card resistant to displacement as described and claimed in my copending patent application Ser. No. 040,100 filed May 18, 1979 and commonly assigned herewith. In this embodiment, a trapezoidal securing segment 28 of the board, underlying and securely adhered to tab 23, is so designed that it forms an aperture in the board upon opening the package. The top and bottom edges of securing segment 28 are formed by knife cuts 29 and 30 completely through the board. Side edges 32*a* and 32*b* of the securing segment are formed by perforated lines in the board. The tab 23 is only bonded to the securing segment 28 of the board. When the tab 23 is lifted, the securing segment 28 is also lifted and tears away from the board remaining bonded to the tab and forming aperture 34 so that when the package is reclosed, the enlarged outer portion of the tab formed by ears 26 may be pushed through the aperture. The ears 26 thus become secured behind the board and maintain the blister in closed position.

Alternatively, the card may have an internal edge defining a cut-out opening and the tab 23 may be pushed through the aperture to provide the initial closing means.

In either embodiment, the ears 26 of tab 23 are secured behind the board to maintain the blister in reclosed position after opening the package.

Figure 2:
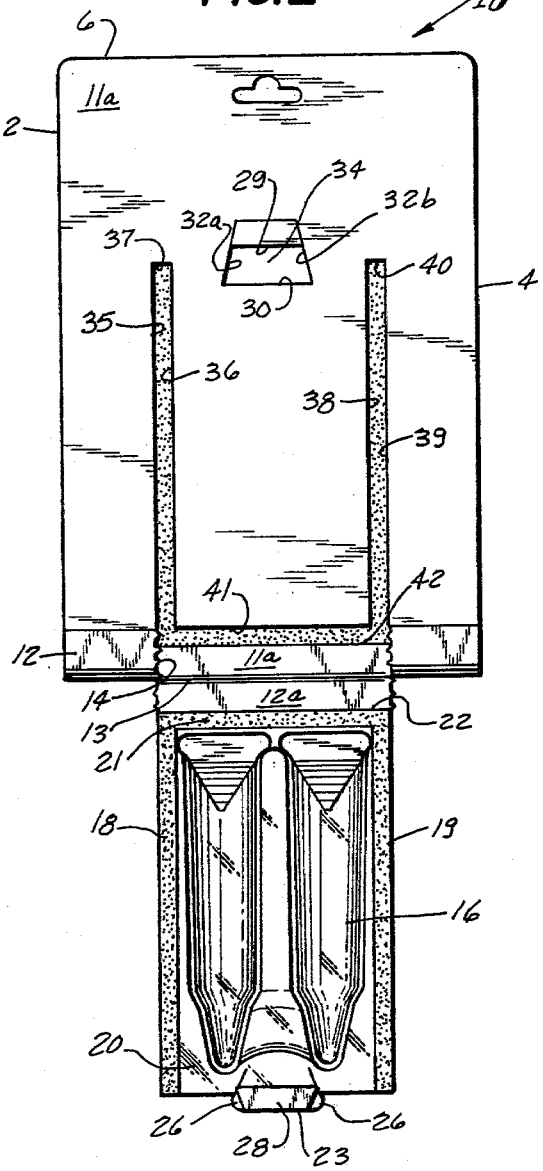
FIG. 2 is a front elevation of the package of FIG. 1, opened.

Cut score lines 35, 36, 37, 38, 39, 40, 41 and 42 are provided in the front surface of the card and extend partially through the thickness of the card along the inner and outer edges of flange portions 18, 19 and 21 at the sides and bottom of the product holding portion 16 of the blister to allow defined ply separation of the paperboard, indicated by stipled areas in FIG. 2, when the opening tab 23 is lifted to open the blister. As illustrated, cut score lines 35, 36 and 37 extend around the adhered flange side portion 18; cut score lines 38, 39 and 40 extend around the adhered flange side portion 19; and cut score lines 41 and 42 extend around adhered flange bottom portion 21.

The blister package is formed by placing blister member 15 on card member 11 and securing the blister flange side and bottom portions 18, 19 and 21 to the underlying portions of the front surface of the card within the area defined by the cut score lines. The flexible tab 23 is then secured to securing segment 28. The blister may be secured to the card by any convenient means including heat sealing, adhesion, etc. After the blister is secured to the card, the bottom panel extension 12 is folded up and secured to the underlying board in the area outside the lines of weakness. Within the area defined by the lines of weakness, the foldover extension **12*b* is secured only at its top edge to the front of the blister flange bottom portion 21 without bonding to the underlying card area. The extension may be secured to the card, outside the lines of weakness, and to the blister flange, within the lines of weakness, by any convenient means, preferably by heat sealing. The lines of weakness 14 in the fold over extension 12 are preferably positioned so as to extend just outside the outer edges of the flange side portions 18 and 19**.

Figure 3:
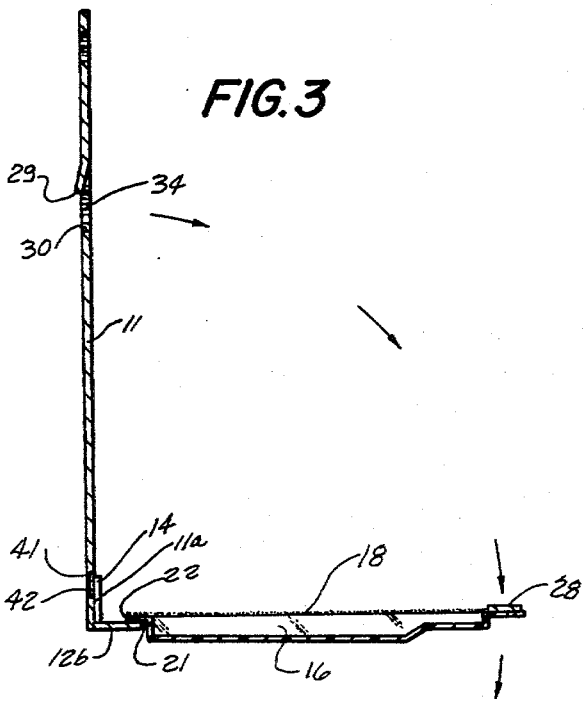
FIG. 3 is a side view; in section, of the package of FIG. 2, partially opened.
Figure 4:
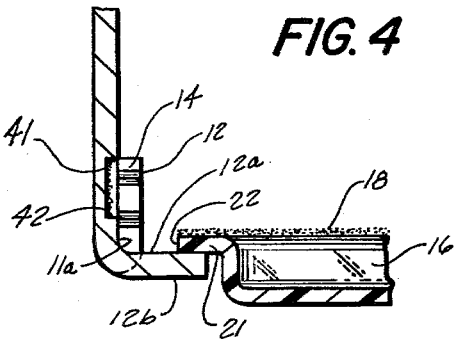
FIG. 4 is an enlarged fragmentary side view of the hinge area of the package of FIG. 3 in greater detail.

To open the package, the user grasps the tab 23 and lifts the tab and blister outwardly away from the board. As the blister is lifted from the board, the paperboard splits between the cut score lines and ply-splitting progresses until it terminates at cut score line 42. Continued lifting of the blister breaks the lines of weakness 14 in the bottom fold over extension 12 permitting the fold-over extension to which the blister bottom flange 21 is bonded at **12*b* to be folded back for removal of the contents. As best seen in FIGS. 2 to 4, the fold over extension bearing the blister is hingedly connected to the board 11 through the bottom fold line 13 which also corresponds to the bottom edge of the package. Because the back portion of the fold over extension 12*a* between the lines of weakness 14 is only bonded to the blister flange portion 21 without bonding to the underlying card area 11*a*, a full thickness of paperboard remains in the opened package at the base area of the card between the cut score line 42 and the top edge of the extension 12*a*. The blister member 10** remains attached to the fold over extension and hingedly connected to the card through a full thickness of paperboard. The arrangement conveys improved tensile strength and the package has enhanced resistance to the inadvertent stripping of the blister from the card. Such resistance and improved tensile strength ensures that the blister will remain attached to the card upon opening so that a recloseable package will be maintained.

The lines of weakness 14 may be in the form of perforations, crease lines, cut score lines, etc. Preferably such lines will be perforations positioned in slightly offset relation respectively to the side portions 18 and 19 of the blister flange. Such an arrangement permits controlled opening of the fold over extension **12*b*** in a predetermined direction even if the blister member is misaligned or offset on the card. The lines of weakness also confine tearing and prevent the board from bending outside the blister area when the package is opened.

Figure 5:
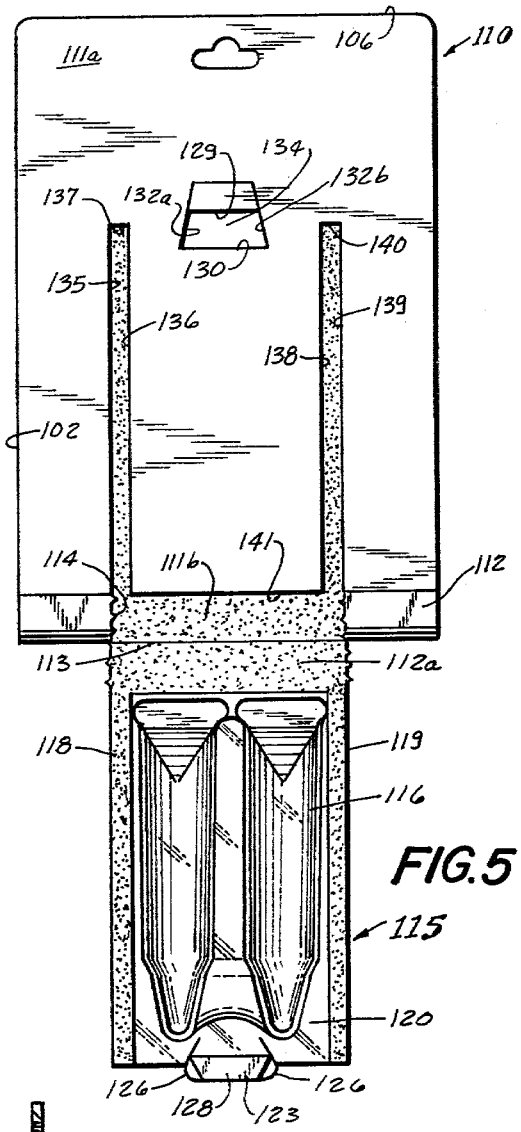
FIG. 5 is a front elevation of a second embodiment of the invention showing the package opened.
Figure 6:
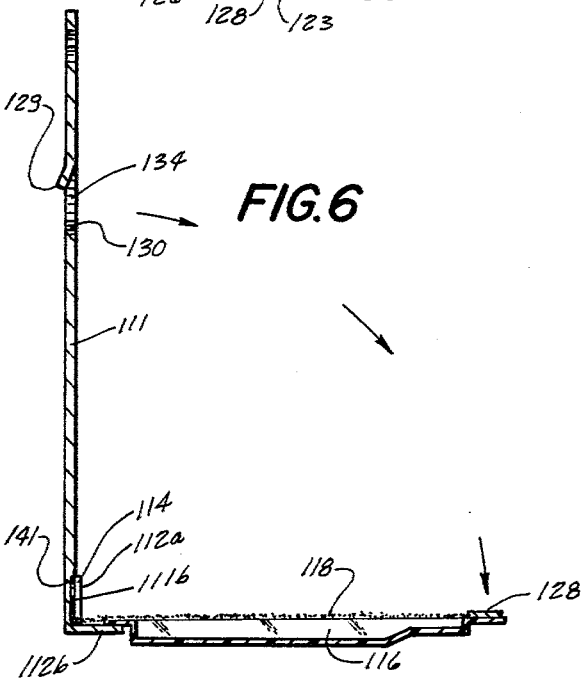
FIG. 6 is a side view, in section, of the package of FIG. 5, partially opened.
Figure 7:
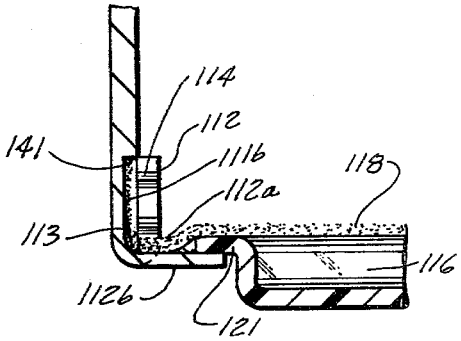
FIG. 7 is an enlarged fragmentary side view of the hinge area of FIG. 6.

Referring to FIGS. 5 to 7, there is illustrated another embodiment of the invention similar to the embodiment of FIG. 1 but wherein the fold over extension is bonded to the underlying board both outside and within the lines of weakness 14. Similar numerals have been used in the drawings for ease of comparison and description of like parts. As will be seen, Package 110 is scored and sealed or otherwise secured in the same manner as described above except that the outer score at the bottom of the blister flange bottom edge, 42 in FIGS. 1 to 4, is omitted. Fold over extension **112*b* is secured to the underlying card area 111*a* as well as to the blister flange 121. Therefore, upon opening the package, ply separation occurs in the entire area between the cut score line 141 and the fold over extension 112*a*. In other words, the package opens with a full base tear leaving paperboard of partial thickness, areas 111*b* and 112*a***, respectively in this area. This arrangement, although providing less improvement in tensile strength than the earlier described embodiment, also has enhanced resistance to inadvertent stripping of the blister member from the card.

Figure 8:
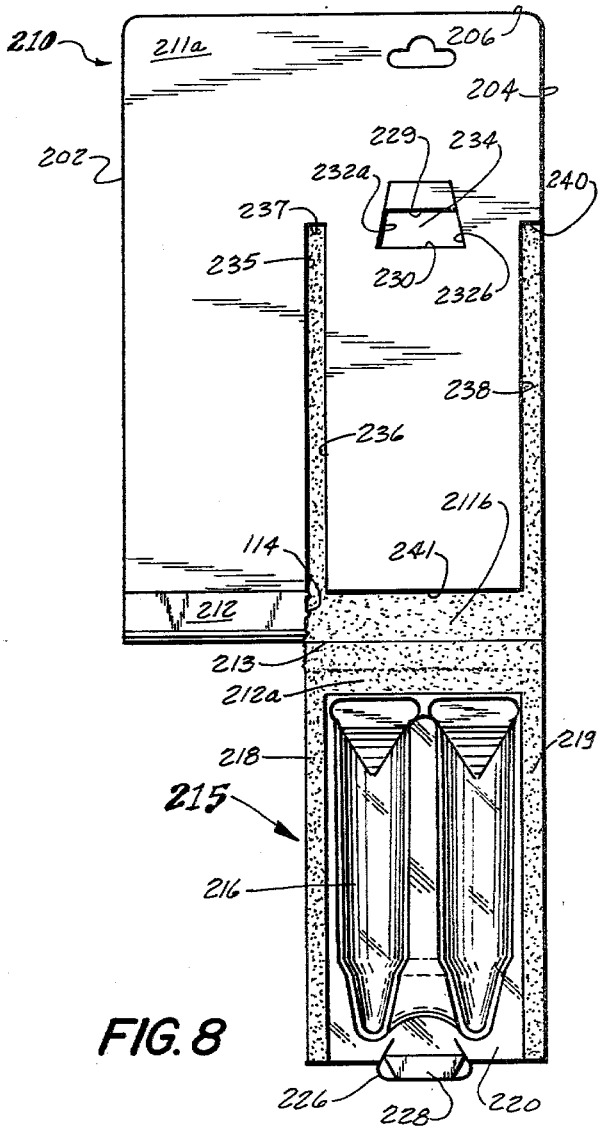
FIG. 8 is a front elevation of a third embodiment of the invention showing the opened package.

FIG. 8 illustrates an additional embodiment of the invention wherein the blister member 215 is positioned adjacent a side edge 204 of the card member **211*a*. Cut score lines 238, 240 and 241 together with the side edge 204 of the card define the boundaries for ply separation between the card 211*a* and the outer edge of blister flange side portion 219. The parts and components and their arrangement are otherwise the same as in the previously described embodiments. It will be understood that this positioning of the blister on the card can also be present in an embodiment wherein cut score line 242 is formed and wherein full thickness of the paperboard is retained in the base area between the fold over extension 212*a* and the cut score line 242**, when such is desired.

It is further understood that the invention is not confined to the particular construction and arrangement of parts herein illustrated and described, but embraces all such modified forms thereof as come within the scope of the following claims.

I claim:

1. A recloseable hinged blister card package, comprising:

(a) a paperboard card having a front surface and a back surface; top and side edges, and means for securing blister tab means to keep the package in closed position;

(b) a plastic blister having a raised product holding portion having top, bottom and side edges, and a peripheral flange at the sides and bottom of said product holding portion, said peripheral flange being secured to the front surface of the card;

(c) opening tab means on said plastic blister cooperating with said means on the card for securing the tab means to keep the package in closed position and for reclosing the package after opening;

(d) cut score lines in the front surface of said card and extending partially through the thickness of said card along the inner and outer edges of the side and bottom portions of said peripheral flange;

(e) a bottom panel fold over extension formed integral with said paperboard card and having spaced lines of weakness extending vertically from the bottom edge of said card to the top end of said extension, said extension being folded upwardly and secured to the underlying paperboard in areas outside said lines of weakness and being secured only to the blister flange bottom portion in areas inside the lines of weakness, whereby said blister may be lifted by said opening tab means with confined ply separation of the paperboard card at the portions thereof that are secured to said peripheral flange without breaking the bond between said blister flange and the front surface of the paperboard card and whereby said blister can be swung open about a hinge line defined by the bottom edge of the card without breaking the bond between the peripheral flange and the fold over extension.

2. A recloseable blister card as claimed in claim 1, in which said lines of weakness in said fold over extension are perforations.

3. A recloseable blister card as claimed in claim 2, in which said paperboard card has an internal edge defining an opening in said card and said opening tab means are adapted to be pushed through said opening when said blister is reclosed for locking said blister in its reclosed position.

4. A recloseable blister card as claimed in claim 2, in which said paperboard card has a securing segment secured to said opening tab means, said securing segment being removable from the card on opening to form an aperture in said card through which a portion of said tab means can be pushed when said blister is reclosed for locking said blister in its reclosed position.

5. A recloseable blister card as claimed in claim 4, in which the base area of the paperboard between the outer bottom cut score line and the top of the fold over extension is of full paperboard thickness in the opened package.

6. A recloseable blister card as claimed in claim 5, in which one of the side edges of the paperboard card underlies an outer edge portion of a side peripheral flange of the blister.

7. A recloseable hinged blister card package, comprising:

(a) a paperboard card having a front surface and a back surface; top and side edges, and means for securing blister tab means to keep the package in closed position;

(b) a plastic blister having a raised product holding portion having top, bottom and side edges, and a peripheral flange at the sides and bottom of said product holding portion, said peripheral flange being secured to the front surface of the card;

(c) opening tab means on said plastic blister cooperating with said means on the card for securing the tab means to keep the package in closed position and for reclosing the package after opening;

(d) cut score lines in the front surface of said card and extending partially through the thickness of said card along the inner and outer edges of the side portions of said peripheral flange and along the inner edge of the bottom portion of said peripheral flange;

(e) a bottom panel fold over extension formed integral with said paperboard card and having spaced lines of weakness extending vertically from the bottom edge of said card to the top end of said extension, said extension being folded upwardly and secured to the underlying paperboard in areas outside said lines of weakness and being secured to both the blister flange bottom portion and the underlying paperboard in areas inside the lines of weakness, whereby said blister may be lifted by said opening tab means with confined ply separation of the paperboard card at the portions thereof that are secured to said peripheral flange without breaking the bond between said blister flange and the front surface of the paperboard card and whereby said blister can be swung open about a hinge line defined by the bottom edge of the card without breaking the bond between the peripheral flange and the fold over extension.

8. A recloseable blister card package as claimed in claim 7, in which said lines of weakness in said fold over extension are perforated lines.

9. A recloseable blister card package as claimed in claim 8, in which said paperboard card has an internal edge defining an opening in said card and said opening tab means are adapted to be pushed through said opening when said blister is reclosed for locking said blister in its reclosed position.

10. A recloseable blister card as claimed in claim 8, in which said paperboard card has a securing segment secured to said opening tab means, said securing segment being removable from the card on opening to form an aperture in said card through which a portion of said tab means can be pushed when said blister is reclosed for locking said blister in its reclosed position.

11. A recloseable blister card package as claimed in claim 10, in which said blister can be swung open effecting ply separation in the base area of the paperboard between the inner bottom cut score line and the top of the fold over extension.

12. A recloseable blister card package as claimed in claim 11, in which one of the side edges of the paperboard card underlies an outer edge portion of a side peripheral flange of the blister.

* * * * *